US011142987B2

(12) United States Patent
Vasques

(10) Patent No.: US 11,142,987 B2
(45) Date of Patent: Oct. 12, 2021

(54) ANNULAR BARRIER SYSTEM

(71) Applicant: WELLTEC OILFIELD SOLUTIONS AG, Zug (CH)

(72) Inventor: Ricardo Reves Vasques, Zug (CH)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 0 days.

(21) Appl. No.: 17/016,864

(22) Filed: Sep. 10, 2020

(65) Prior Publication Data

US 2021/0071495 A1 Mar. 11, 2021

(30) Foreign Application Priority Data

Sep. 11, 2019 (EP) ..... 19196832

(51) Int. Cl.
*E21B 33/124* (2006.01)
*E21B 33/12* (2006.01)
*E21B 33/127* (2006.01)

(52) U.S. Cl.
CPC ..... *E21B 33/1243* (2013.01); *E21B 33/1208* (2013.01); *E21B 33/1277* (2013.01)

(58) Field of Classification Search
CPC .. E21B 33/12; E21B 33/1243; E21B 33/1208; E21B 33/1277; E21B 33/127;
(Continued)

(56) References Cited

U.S. PATENT DOCUMENTS 3,876,000 A * 4/1975 Nutter ..... E21B 49/088 166/106
10,400,542 B2 * 9/2019 Hazel ..... E21B 33/127
(Continued)

FOREIGN PATENT DOCUMENTS

WO 2013/079574 6/2013

OTHER PUBLICATIONS

Extended Search Report for EP19196832, dated Feb. 17, 2020, 6 pages.

*Primary Examiner* — Yong-Suk (Philip) Ro
(74) *Attorney, Agent, or Firm* — Nixon & Vanderhye P.C.

(57) ABSTRACT

The present invention relates to an annular barrier system for completing a well with a well tubular metal structure, comprising the well tubular metal structure and a first annular barrier and a second annular barrier, each annular barrier comprising a tubular metal part having a bore and mounted as part of the well tubular metal structure, an expandable metal sleeve surrounding the tubular metal part, each end of the expandable metal sleeve being connected with the tubular metal part, and an annular space between the expandable metal sleeve and the tubular metal part, each annular barrier being introduced and set in the well to abut a wall of the well, providing a confined space having a confined pressure Pc between the wall, part of the well tubular metal structure, the first annular barrier and the second annular barrier, so that the first annular barrier isolates the confined space from a first annulus having a first pressure, and the second annular barrier isolates the confined space from a second annulus having a second pressure, wherein the annular barrier system comprises a valve system having a first position in which the bore is in fluid communication with the annular space of at least one of the first annular barrier and the second annular barrier in order to expand the expandable metal sleeve, and a second position in which the bore is in fluid communication with the confined space in order to perform barrier verification by pressurising the confined space.

15 Claims, 10 Drawing Sheets

Figure 1:
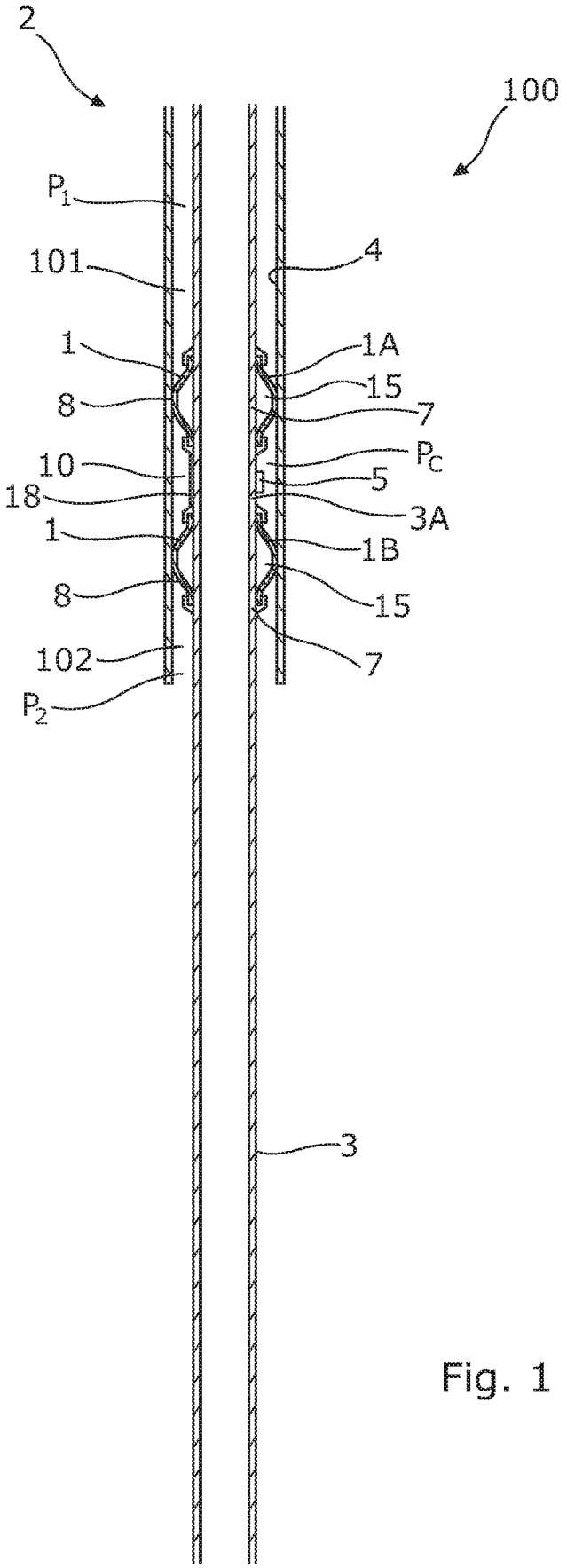

(58) Field of Classification Search
CPC .... E21B 33/124; E21B 33/122; E21B 33/128; E21B 33/1285; E21B 33/101
See application file for complete search history.

(56) References Cited

U.S. PATENT DOCUMENTS

| | | | | |
|---|---|---|---|---|
| 10,519,741 | B2 * | 12/2019 | Vasques | F16K 15/207 |
| 2006/0248949 | A1 | 11/2006 | Gregory et al. | |
| 2009/0183882 | A1 | 7/2009 | Van Zuilekom et al. | |
| 2013/0118751 | A1 | 5/2013 | Landsiedel | |
| 2016/0298414 | A1 * | 10/2016 | St hr | E21B 33/127 |
| 2017/0175485 | A1 * | 6/2017 | Vasques | E21B 17/00 |
| 2017/0321515 | A1 * | 11/2017 | St hr | E21B 34/063 |
| 2018/0094506 | A1 * | 4/2018 | Vasques | E21B 41/0085 |

* cited by examiner

ANNULAR BARRIER SYSTEM

This application claims priority to EP Patent Application No. 19196832.0 filed 11 Sep. 2019, the entire contents of which is hereby incorporated by reference.

The present invention relates to an annular barrier system for completing a well with a well tubular metal structure having a first annular barrier and a second annular barrier.

When completing a well using any kind of isolation, it is desired to test whether the isolation is sufficient. For many years, cement has been used for isolation, and subsequently the casing and the surrounding cement have been perforated to gain reservoir access. However, cement logging has proven to be very difficult and not very reliable. Another kind of isolation is to use packers, e.g. metal packers or swellable packers.

It is an object of the present invention to wholly or partly overcome the above disadvantages and drawbacks of the prior art. More specifically, it is an object to provide an improved annular barrier system in which the barrier provided by two adjacent annular barriers can be verified.

The above objects, together with numerous other objects, advantages and features which will become evident from the below description, are accomplished by a solution in accordance with the present invention by an annular barrier system for completing a well with a well tubular metal structure, comprising: the well tubular metal structure and a first annular barrier and a second annular barrier, each annular barrier comprising:

a tubular metal part having a bore and mounted as part of the well tubular metal structure, an expandable metal sleeve surrounding the tubular metal part, each end of the expandable metal sleeve being connected with the tubular metal part, and an annular space between the expandable metal sleeve and the tubular metal part, each annular barrier being introduced and set in the well to abut a wall of the well, providing a confined space having a confined pressure between the wall, part of the well tubular metal structure, the first annular barrier and the second annular barrier, so that the first annular barrier isolates the confined space from a first annulus having a first pressure, and the second annular barrier isolates the confined space from a second annulus having a second pressure, wherein the annular barrier system comprises a valve system having a first position in which the bore is in fluid communication with the annular space of at least one of the first annular barrier and the second annular barrier in order to expand the expandable metal sleeve, and a second position in which the bore is in fluid communication with the confined space in order to perform barrier verification by pressurising the confined space.

By having two annular barriers and a valve assembly having a second position providing fluid communication to the confined space after the annular barriers have been set, the barrier provided by the first and second annular barriers can be verified since the confined space provided between the two annular barriers can be pressurised as part of the barrier setting procedure.

By "each annular barrier being introduced and set in the well to abut a wall of the well" is meant that each annular barrier is being introduced and expanded in the well to abut a wall of the well.

In addition, in the first position the bore may be in fluid communication with both the first annular barrier and the second annular barrier in order to expand both expandable metal sleeves simultaneously.

Moreover, the first and second annular barriers may be fluidly connected by means of a fluid channel.

Also, the valve assembly may comprise a third position in which fluid communication with the bore is closed.

Furthermore, in the second position the bore may be in fluid communication with the annular space of at least one of the annular barriers.

Additionally, in the first position the bore may be fluidly disconnected from the confined space.

Moreover, the annular barrier system may comprise a pressure-equalising unit having a first aperture in fluid communication with the first annulus, a second aperture in fluid communication with the second annulus and a third aperture in fluid communication with the valve assembly, the pressure-equalising unit having a first unit position in which the first aperture is in fluid communication with the third aperture and a second position in which the second aperture is in fluid communication with the third aperture.

Further, in the first position of the valve assembly, the third aperture may be in fluid communication with the confined space via the valve assembly, preventing pressure from being trapped in the confined space during expansion of the expandable metal sleeves.

In addition, in the second position the confined space may be fluidly disconnected from the third aperture.

Furthermore, in the first position the bore may be fluidly connected to at least one of the annular barriers without using the pressure-equalising unit.

Also, in the third position of the valve assembly, the third aperture may be in fluid communication with the annular space.

Furthermore, in the third position of the valve assembly, the third aperture may be in fluid communication with the confined space.

Additionally, in the third position of the valve assembly, the annular space may be in fluid communication with the confined space.

Moreover, in the first unit position the first annulus may be in fluid communication with the confined space via the valve assembly, and in the second unit position the second annulus may be in fluid communication with the confined space via the valve assembly, the first pressure being higher than the second pressure in the first unit position, and the second pressure being higher than the first pressure in the second unit position.

In addition, the pressure-equalising unit may comprise an element movable at least between the first unit position and the second unit position, the pressure-equalising unit having the first aperture which is in fluid communication with the first annulus, the second aperture which is in fluid communication with the second annulus and the third aperture which is in fluid communication with the confined space via the valve assembly; and in the first unit position the first aperture is in fluid communication with the third aperture equalising the first pressure with the confined pressure via the valve assembly; and in the second unit position the second aperture is in fluid communication with the third aperture, equalising the second pressure with the confined pressure via the valve assembly; and in the first unit position the first pressure is higher than the second pressure, and in the second unit position the second pressure is higher than the first pressure.

In that way, it is obtained that the confined space is also pressure-equalised to have the highest pressure, thus providing the same pressure condition as when each of the first and second annular barrier is tested. Thus, the first annular barrier will only experience a differential pressure where the highest pressure is in the confined space compared to that of the first annulus, which is the same pressure situation as when the first annular barrier is tested during the setting procedure, and likewise the second annular barrier will also only experience a differential pressure across the barrier where the highest pressure is in the confined space compared to that of the second annulus.

Further, the pressure-equalising unit may have a first unit position in which the first annulus is in fluid communication with the confined space and a second unit position in which the second annulus is in fluid communication with the confined space; in the first unit position the second pressure is higher than the first pressure, and in the second unit position the first pressure is higher than the second pressure.

Also, a first fluid channel may be fluidly connecting the first aperture with the first annulus, a second fluid channel fluidly connecting the second aperture with the second annulus.

Additionally, the first fluid channel may be arranged between the expandable metal sleeve and the tubular metal part of the first annular barrier.

Furthermore, the second fluid channel may be arranged between the expandable metal sleeve and the tubular metal part of the second annular barrier.

Moreover, the valve assembly may have a first piston moving a first bore, the first piston having a first piston part and a second piston part; in the first position the first piston part divides the first bore into a first bore part and a second bore part; and in the first position the first bore part has a first opening in fluid communication with the bore and a second opening in fluid communication with the annular space of at least one of the first annular barrier and the second annular barrier; and in the first position the second bore part has a third opening in fluid communication with the first annulus or the second annulus.

Further, in the first position the second bore part of the first bore may have a third opening in fluid communication with the pressure-equalising unit.

In addition, the first piston part and the second piston part of the first piston may be connected by an intermediate part.

Moreover, the first piston part may have a smaller cross-sectional area than the second piston part.

Additionally, the first piston part may have a first area.

Furthermore, the second piston part may have a second area.

Also, the intermediate part may have an outer diameter that is smaller than the first outer diameter of the first piston part and the second outer diameter of the second piston part.

In addition, the intermediate part may have a smaller cross-sectional area than the first piston part and the second piston part.

Further, the second piston part may separate the second bore part from a third bore part.

Moreover, the first piston may have a through-bore providing fluid communication between the first bore part and the third bore part.

Additionally, in the third position fluid may be allowed to flow between the third opening and the second opening on the outside of the intermediate part.

Furthermore, the first piston may have a fastening means preventing the first piston from returning to the first position.

In addition, the fastening means may be at least one element moving radially inwards.

Also, the fastening means may be at least one element moving radially inwards in the third bore part behind the second piston part.

Further, the fastening means may be several elements in the form of collets.

Moreover, the elements may be forced radially inwards by a flexible ring.

Additionally, the second opening in the second position may be in fluid communication with the confined space.

Furthermore, the second opening may be in fluid communication with a fluid channel.

Also, the fluid channel may connect the second opening to the annular space and the confined space.

In addition, the second opening may be in fluid communication with a fluid channel being blocked by a shear disc so that fluid communication to the confined space is allowed when the pressure exceeds a certain threshold, thus breaking the disc.

Moreover, the valve assembly may change to the third position as the first piston moves in the first bore, the first piston blocking fluid communication with the bore in the third position.

Additionally, the valve assembly may have a second piston moving a second bore, the second piston having a first piston part and a second piston part; in the first position the second piston divides the second bore into a first bore part and a second bore part, and in the first position the second bore part has a fourth opening in fluid communication with the second opening, and the first bore part has a fifth opening in fluid communication with the confined space.

Further, the second piston part of the second piston may separate the second bore part from a third bore part.

Also, the first bore part of the second bore of the valve assembly may have a sixth opening in fluid communication with the first or second annulus.

In addition, the first bore part of the second bore of the valve assembly may have a sixth opening in fluid communication with the pressure-equalising unit.

Moreover, the first piston part and the second piston part of the second piston may be connected by an intermediate part.

Furthermore, the first piston part of the second piston may have a smaller cross-sectional area than the second piston part.

Additionally, the first piston part of the second piston may have a first area.

Further, the second piston part of the second piston may have a second area.

In addition, the intermediate part of the second piston may have an outer diameter that is smaller than the first outer diameter of the first piston part and the second outer diameter of the second piston part.

Moreover, the intermediate part of the second piston may have a smaller cross-sectional area than the first piston part and the second piston part.

Furthermore, the intermediate part of the second piston may have a central opening into a central bore fluidly connecting the second bore part and the third bore part of the second bore.

Additionally, the central bore may not be a through-bore.

Also, the first piston part may be solid.

Further, the second piston may have fastening means prohibiting the second piston from returning to the first position.

Moreover, the fastening means may be at least one element moving radially inwards.

In addition, the fastening means may be at least one element moving radially inwards in the third bore part behind the second piston part.

Furthermore, the fastening means may be several elements in the form of collets.

Additionally, the elements may be forced radially inwards by a flexible ring.

Moreover, the piston may have sealing means.

The valve assembly may further comprise a first shear pin engaging the first piston so as to prevent the first piston from moving before the expandable metal sleeves of the annular barriers are expanded.

In addition, the valve assembly may further comprise a second shear pin engaging the second piston so as to prevent the second piston from moving before the expandable metal sleeves of the annular barriers are expanded, the first shear pin being designed to break after the second shear pin.

Also, the first piston in the first bore and the second piston in the second bore may be arranged in the same valve block.

Furthermore, the annular barrier system may comprise a third annular barrier so that the expanded first and second annular barriers enclose the confined space, and the expanded second and third annular barriers enclose another confined space. The two confined spaces are fluidly connected by a fluid channel, and the annular barriers are fluidly connected via other fluid channels.

Figure 2:
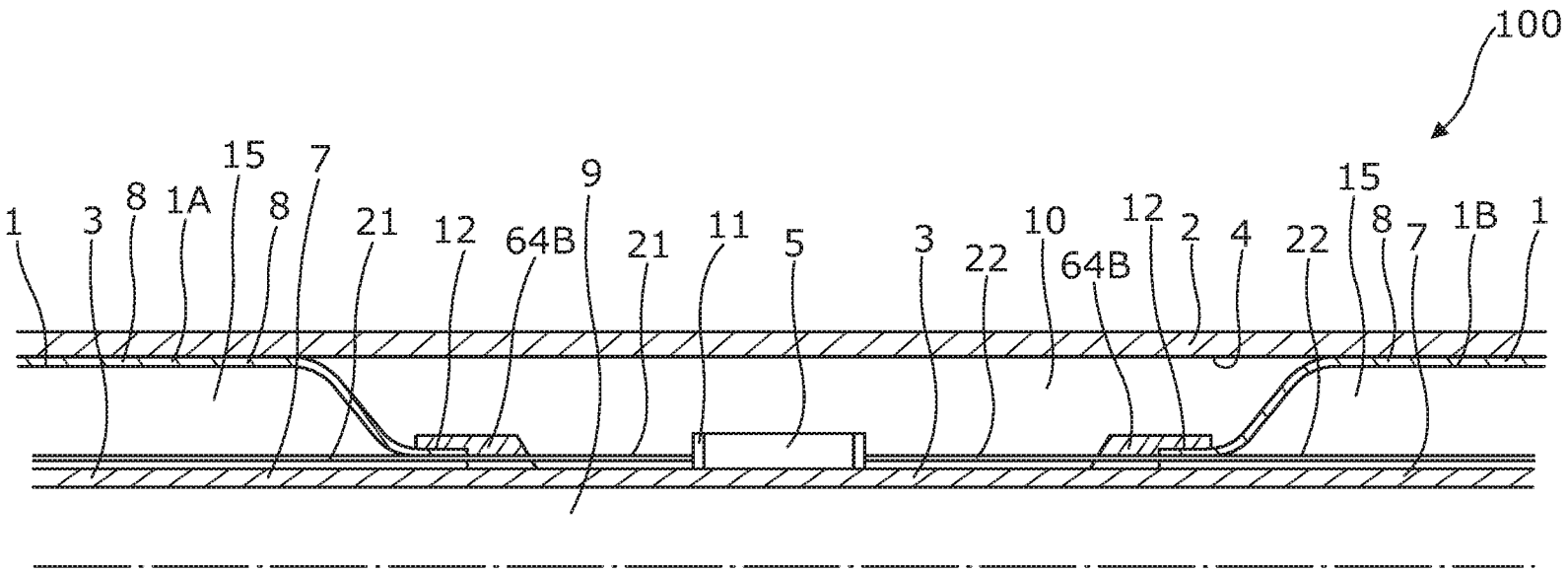
Figure 3A:
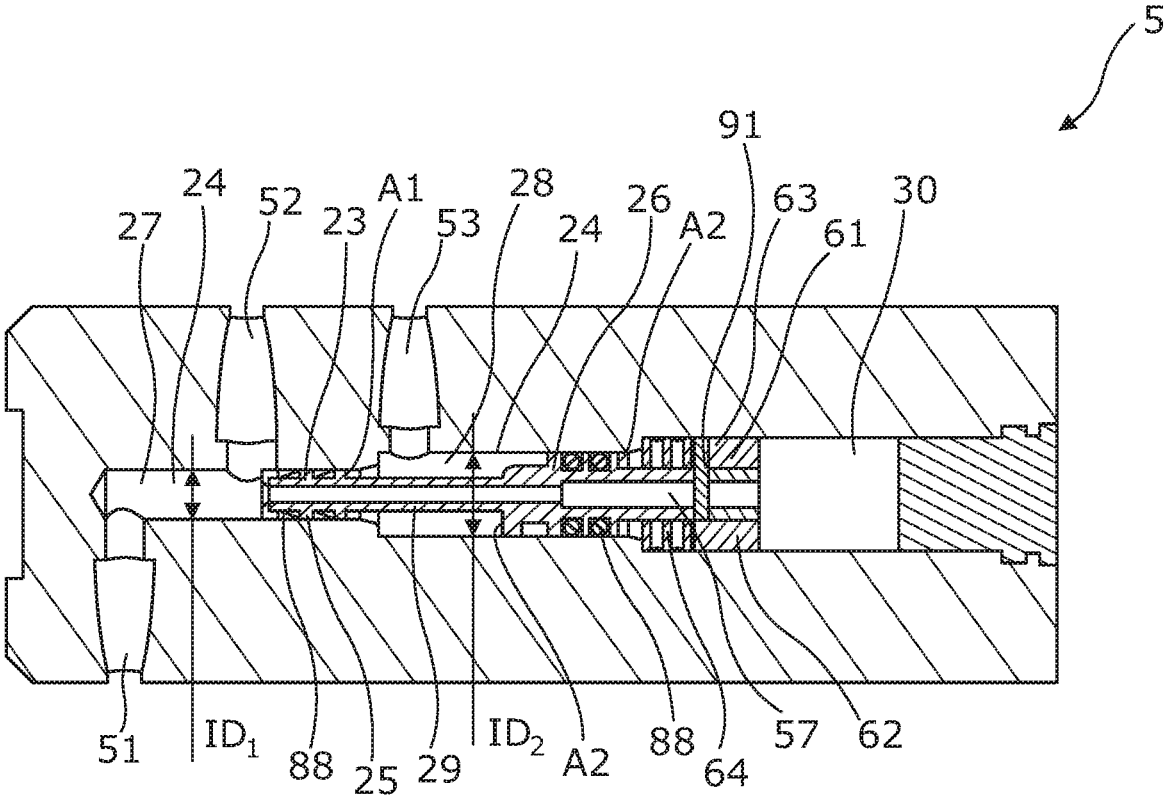
Figure 3B:
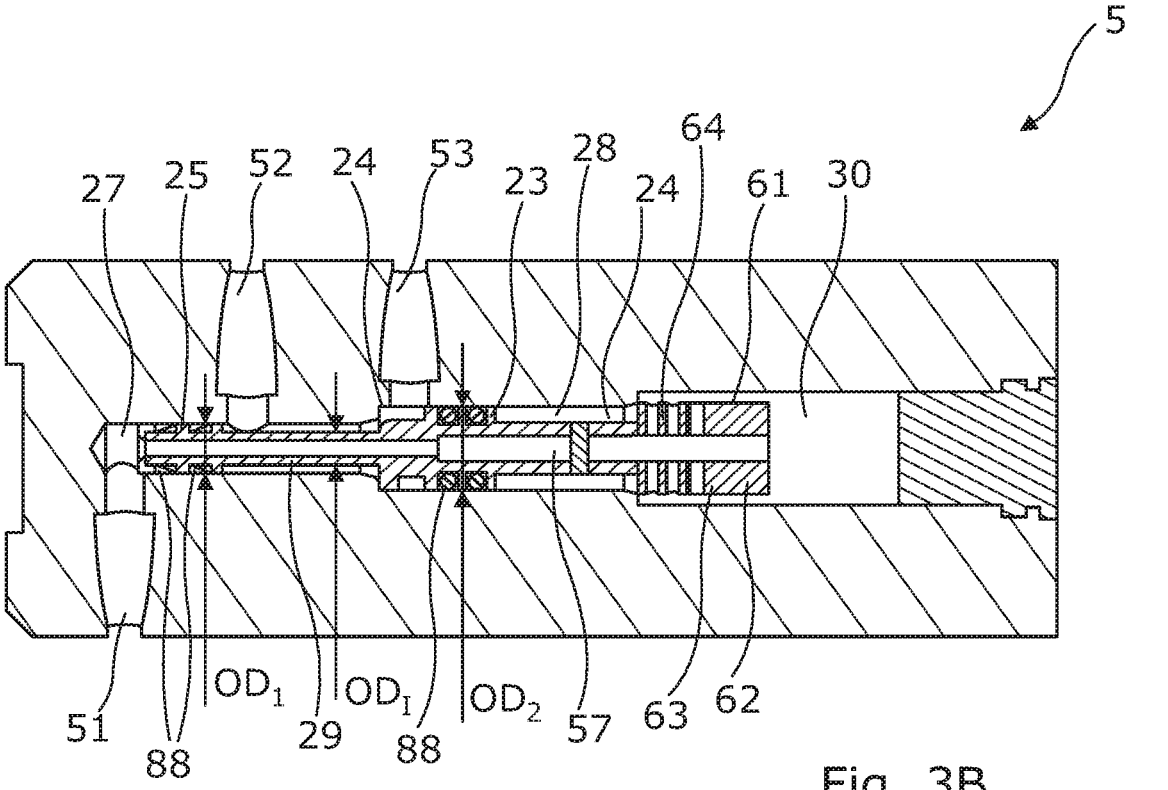
Figure 4A:
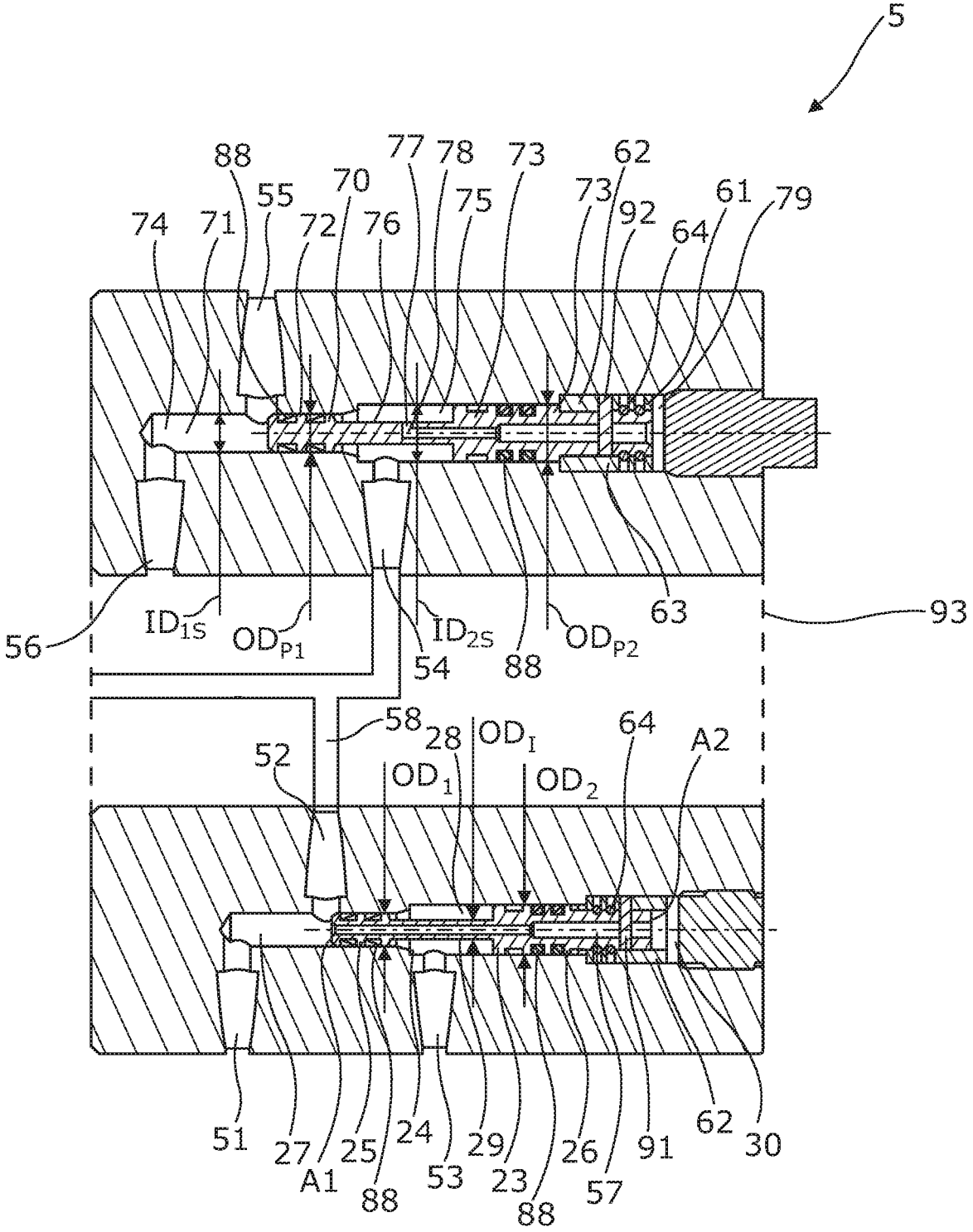
Figure 4B:
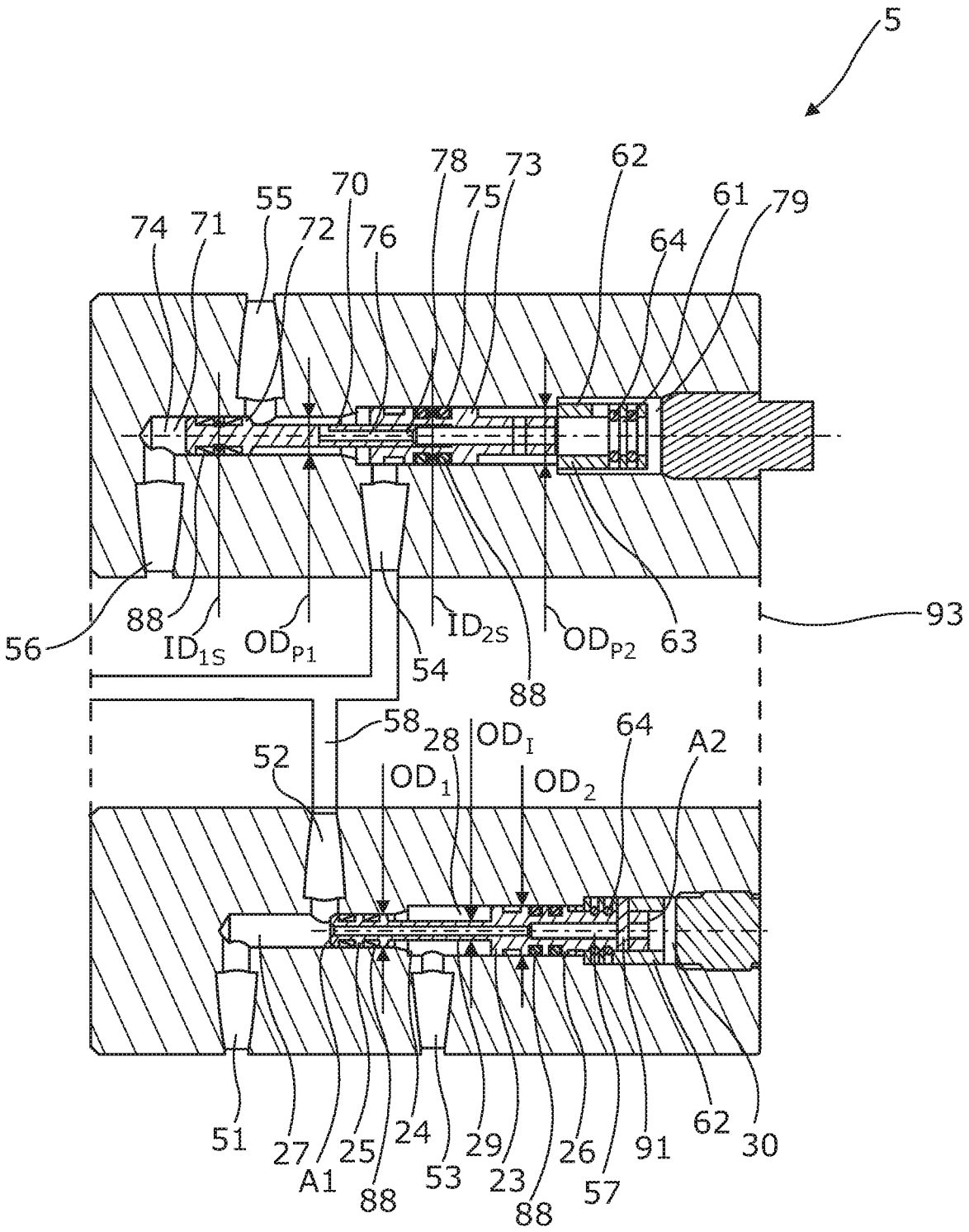
Figure 4C:
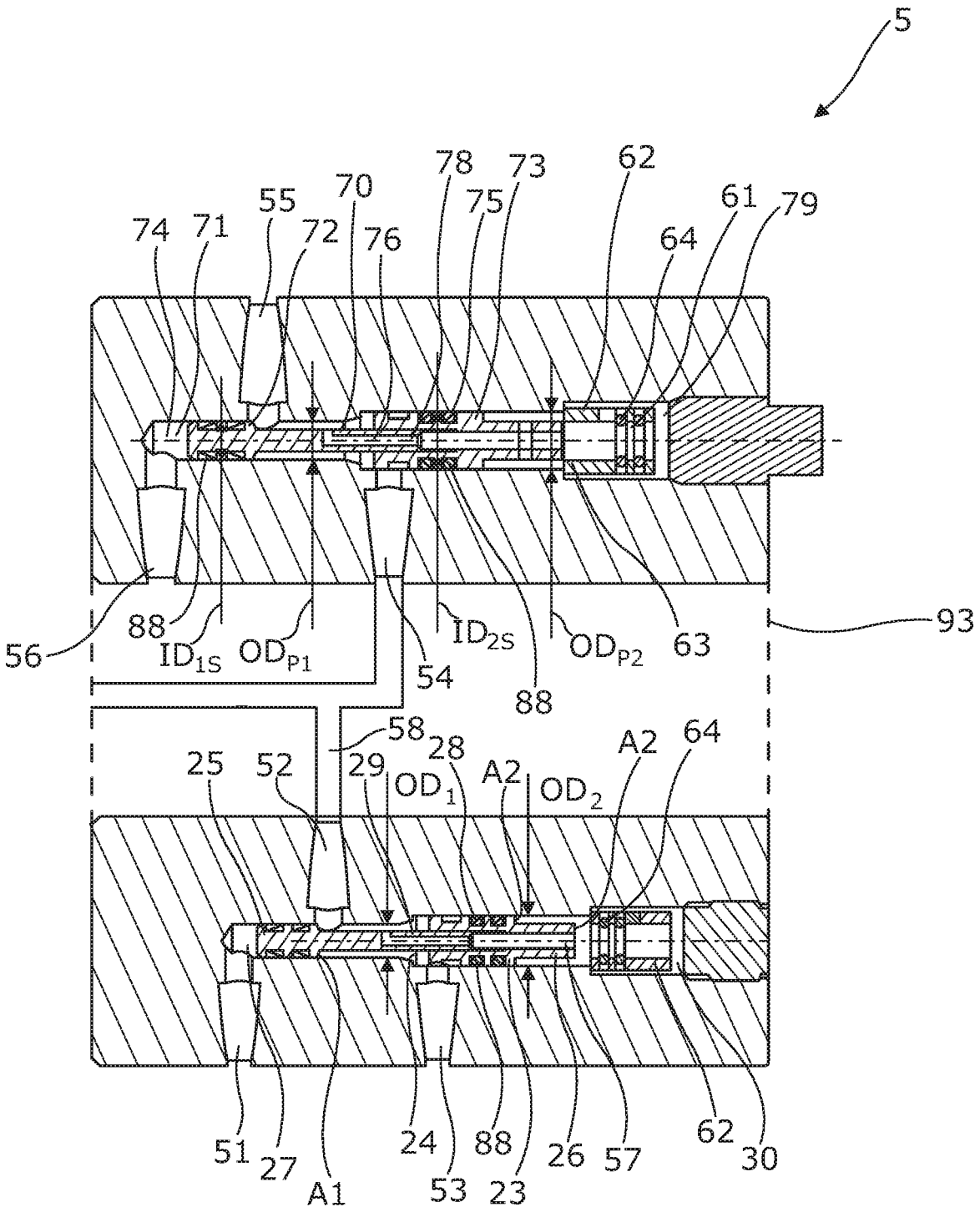
Figure 5:
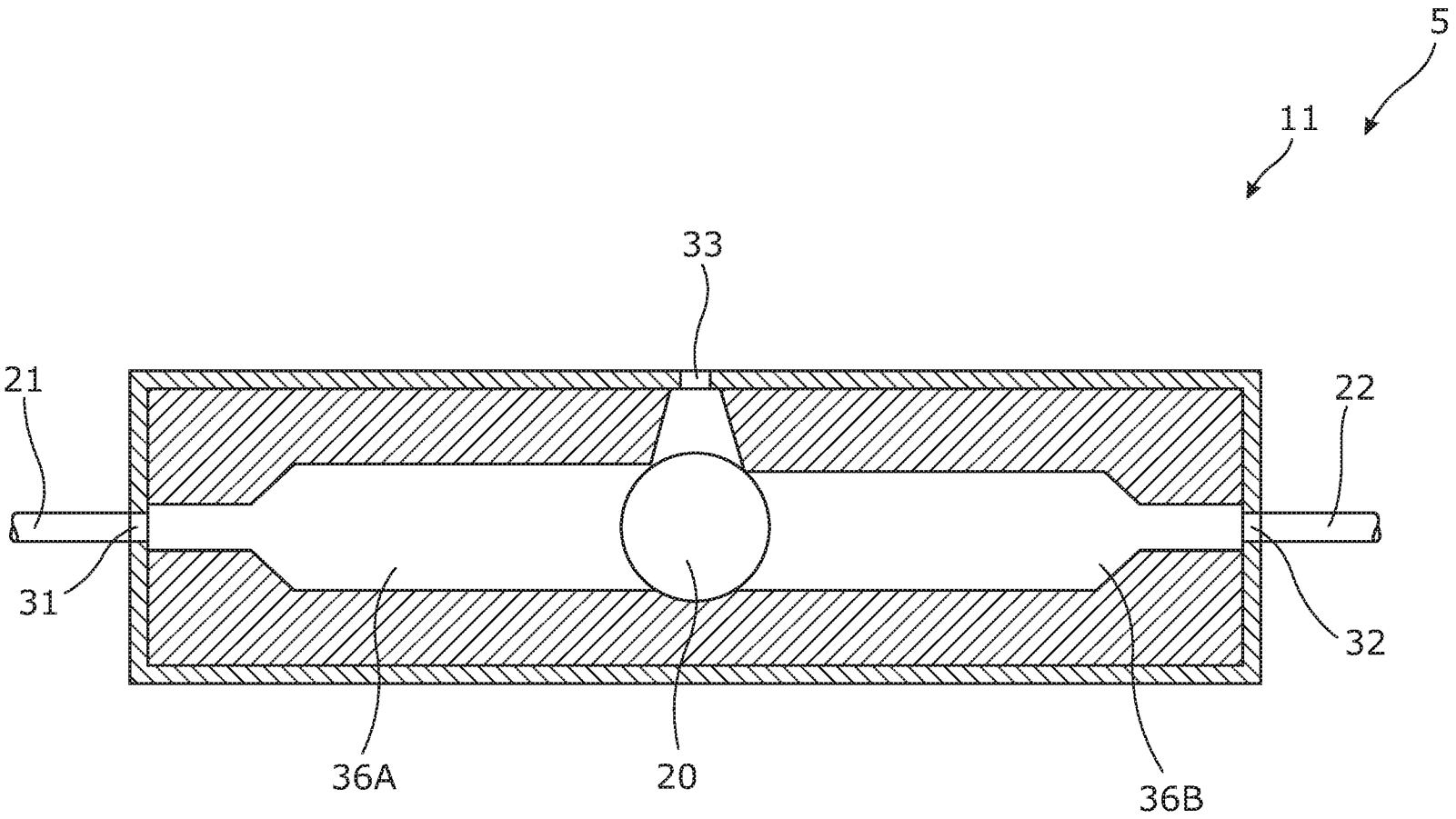
Figure 6A:
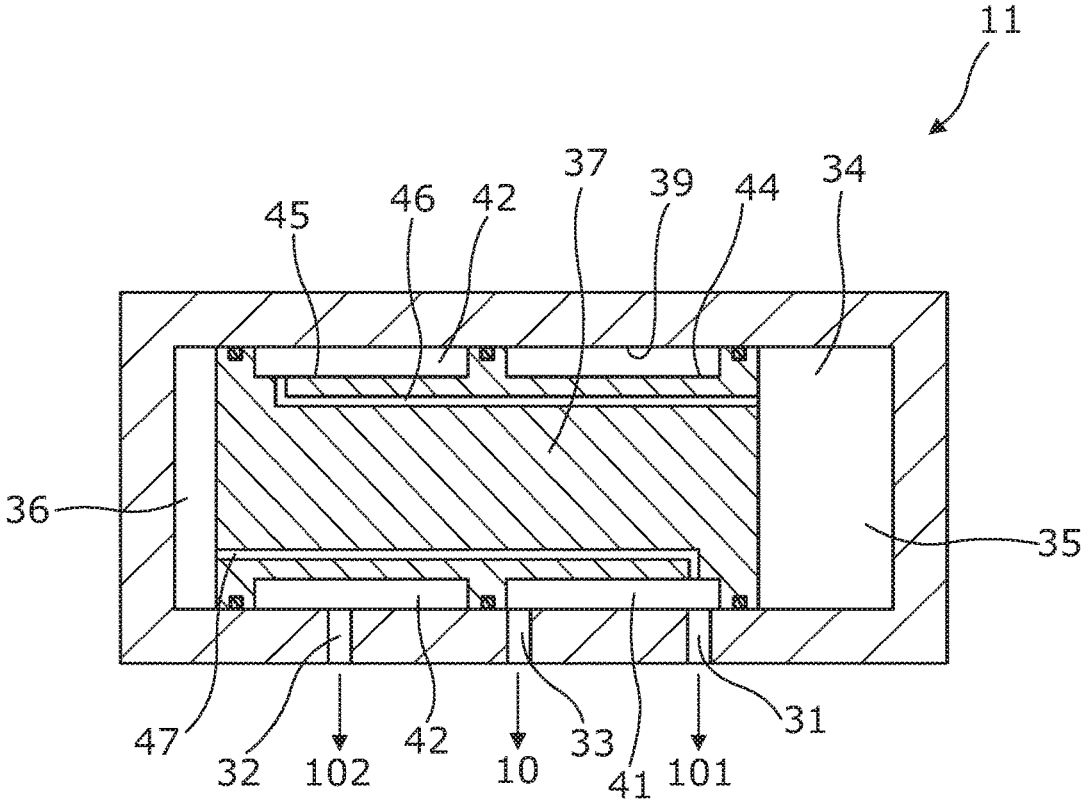
Figure 6B:
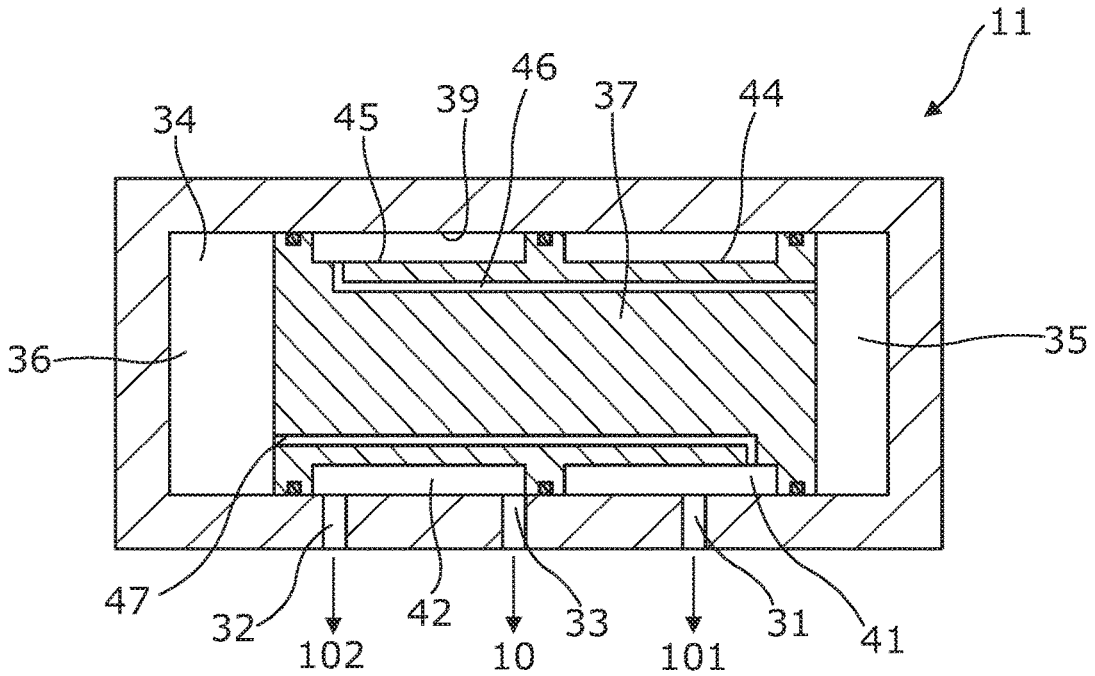
Figure 7:
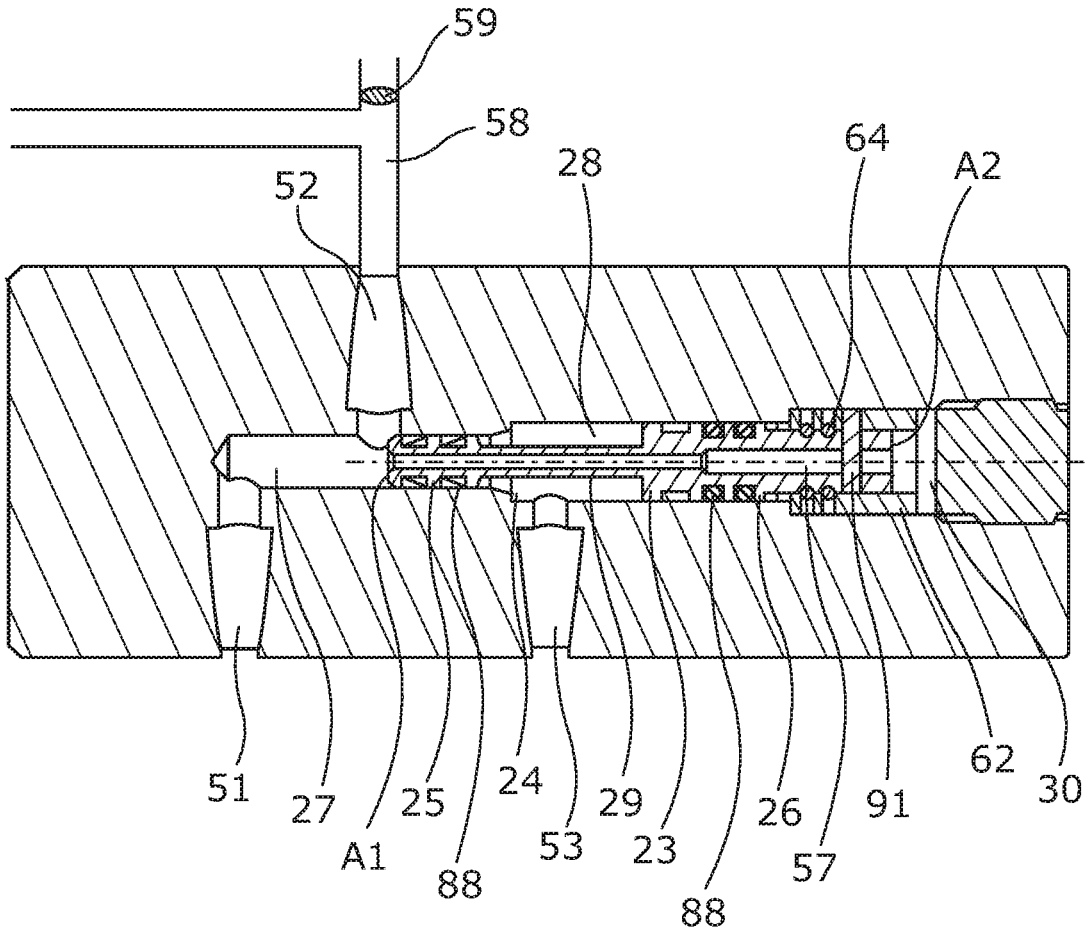
Figure 8:
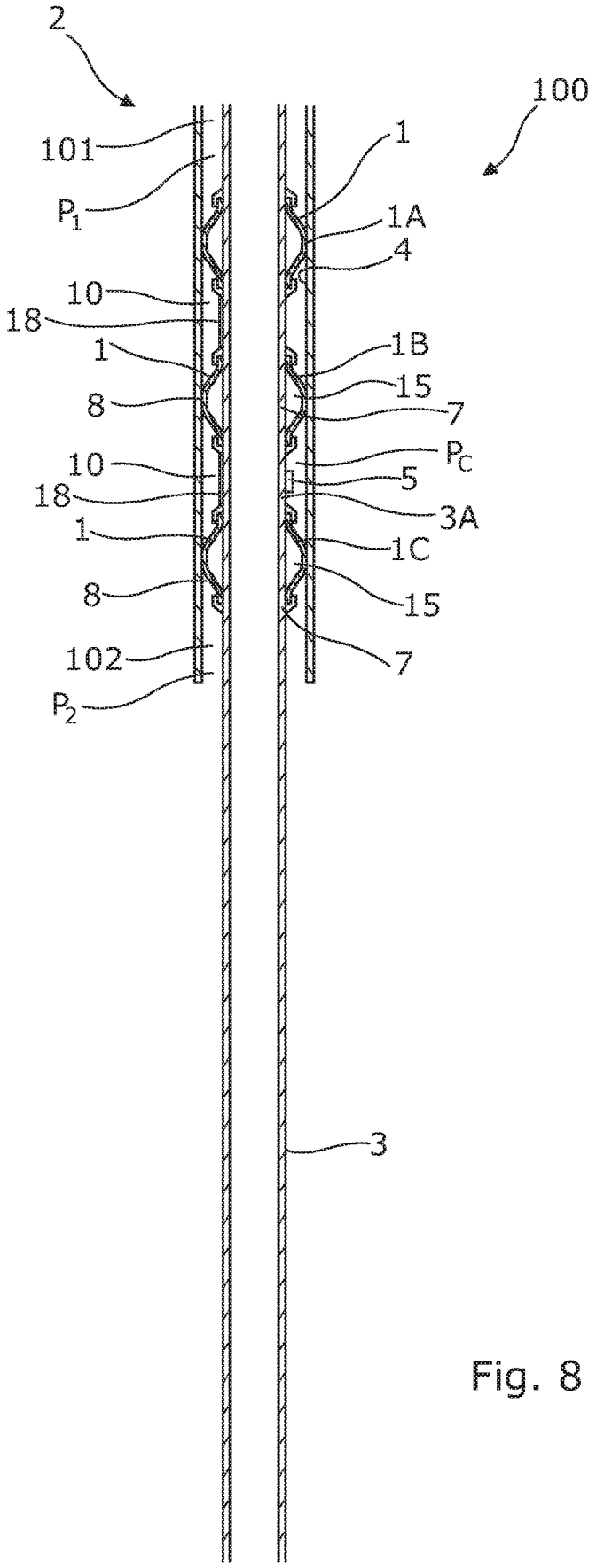

The invention and its many advantages will be described in more detail below with reference to the accompanying schematic drawings, which for the purpose of illustration show some non-limiting embodiments and in which:

FIG. 1 shows a cross-sectional view of an annular barrier system where annular barriers of a well tubular metal structure are set within another well tubular metal structure, forming a confined space which is pressure-tested to perform barrier verification, FIG. 2 shows a partly cross-sectional view of an annular barrier system having a valve assembly, FIG. 3A shows a cross-sectional view of a valve assembly in its initial position, FIG. 3B shows a cross-sectional view of the valve assembly of FIG. 3A in its end position, FIG. 4A shows a cross-sectional view of a valve assembly in a first position where at least one of the annular barriers is expanded, FIG. 4B shows a cross-sectional view of a valve assembly in a second position in which the confined space is pressure-tested, FIG. 4C shows a cross-sectional view of a valve assembly in a third position in which fluid communication to the bore of the well tubular metal structure is closed, FIG. 5 shows a cross-sectional view of a pressure-equalising unit in a neutral position before being changed to provide fluid communication to the higher of the first and the second annulus, FIG. 6A shows a cross-sectional view of another pressure-equalising unit in a first unit position, FIG. 6B shows the pressure-equalising unit of FIG. 6A in a second unit position, FIG. 7 shows a cross-sectional view of another valve assembly in the first position, and FIG. 8 shows a partly cross-sectional view of an annular barrier system having three annular barriers and a valve assembly.

All the figures are highly schematic and not necessarily to scale, and they show only those parts which are necessary in order to elucidate the invention, other parts being omitted or merely suggested.

FIG. 1 shows an annular barrier system 100 for completing a well 2 with a well tubular metal structure 3. The annular barrier system 100 comprises the well tubular metal structure and a first annular barrier 1, 1A and a second annular barrier 1, 1B. Each annular barrier comprises a tubular metal part 7 having a bore 9 (shown in FIG. 2) which is also the bore of the well tubular metal structure as the tubular metal part is mounted as part of the well tubular metal structure. Each annular barrier further comprises an expandable metal sleeve 8 surrounding the tubular metal part. Each end 12 (shown in FIG. 2) of the expandable metal sleeve is connected with the tubular metal part, providing an annular space 15 between the expandable metal sleeve and the tubular metal part. The annular barriers are introduced and set in the well to abut a wall 4 of the well, providing a confined space 10 having a confined pressure Pc between the wall, part of the well tubular metal structure 3A, the first annular barrier and the second annular barrier so that the first annular barrier isolates the confined space from a first annulus 101 having a first pressure $P_1$, the second annular barrier isolating the confined space from a second annulus 102 having a second pressure $P_2$. The annular barrier system further comprises a valve assembly 5 having a first position in which the bore is in fluid communication with the annular space of at least one of the first annular barrier and the second annular barrier in order to expand at least one of the expandable metal sleeves, and a second position in which the bore is in fluid communication with the confined space in order to perform barrier verification by pressurising the confined space. If the pressure can be maintained at a constant, the first annular barrier and the second annular barrier provide a barrier, and this barrier is verified by the pressure test of the confined space. The first annular barrier is tested to withstand a higher pressure in the confined space than in the first annulus on the other side of the first annular barrier, and the second annular barrier is tested to withstand a higher pressure in the confined space than in the second annulus on the other side of the second annular barrier. In FIG. 1, the first annular barrier is the top annular barrier, and the second annular barrier is the lower annular barrier, and when pressure-testing the confined space by applying a higher pressure in the confined space than in the first annulus and the second annulus, the first annular barrier is pressure-tested from below, and the second annular barrier is pressure-tested from above. In that way, the collapse resistance of the annular barriers is tested.

The valve assembly has a first position called expansion mode in which at least one of the annular barriers is expanded, a second position called barrier testing mode in which the barrier, i.e. the barrier provided by the first and second annular barriers, is tested, and an optional third position in which fluid communication to the bore is blocked.

In FIG. 2, the valve assembly 5 is in fluid communication with both the first annular barrier and the second annular barrier so that in the first position of the valve assembly the bore 9 is in fluid communication with both the first annular barrier and the second annular barrier through the valve assembly in order to expand both expandable metal sleeves simultaneously. In FIG. 1, the first and second annular barriers are fluidly connected by means of a fluid channel 18, and in FIG. 2 the valve assembly fluidly connects the first annular barrier and the second annular barrier.

As shown in FIG. 7, the second opening is in fluid communication with a fluid channel 58 being blocked by a shear disc 59 so that fluid communication to the confined space is allowed when the pressure exceeds a certain threshold, breaking the disc, and the valve assembly changes to the second position. The disc thus prevents the valve assembly from changing to the second position before the annular barriers have been expanded. In the second position, the fluid pressure is increased, thereby pressurising the confined space to verify the barrier.

In FIG. 3A, the valve assembly 5 is disclosed in the first position, and the bore is fluidly disconnected from the confined space. In the second position, the disc is broken so that the bore is fluidly connected to the confined space. In FIG. 3B, the valve assembly 5 is in a third position in which fluid communication with the bore is closed, and fluid communication between the annular barriers, the confined space and at least one of the first and second annulus is provided. The pressure-equalising unit 11 has a first unit position in which the first annulus 101 is in fluid communication with the confined space 10 via the second opening and a second unit position in which the second annulus 102 is in fluid communication with the confined space 10; in the first unit position the second pressure $P_2$ is higher than the first pressure $P_1$, and in the second position the first pressure $P_1$ is higher than the second pressure $P_2$.

The valve assembly 5 has a first piston 23 moving a first bore 24. The first piston has a first piston part 25 having a first outer diameter $OD_1$ and a second piston part 26 having a second outer diameter $OD_2$ which is larger than the first outer diameter. In the first position, the first piston part divides the first bore into a first bore part 27 and a second bore part 28. The first bore part has a first opening 51 in fluid communication with the bore and a second opening 52 in fluid communication with the annular space of at least one of the first annular barrier and the second annular barrier, and if the second opening is connected with a pressure-equalising unit 11, the second opening is connected with the annular space of both annular barriers. In the first position, the second bore part has a third opening 53 in fluid communication with the first annulus or the second annulus. The first piston part 25 has an outer diameter matching the inner diameter of the first bore part $ID_1$, and the second piston part 26 has an outer diameter matching the inner diameter of the second bore part $ID_2$. The first piston part 25 and the second piston part 26 of the first piston are connected by an intermediate part 29. The first piston part has a smaller cross-sectional area than the second piston part. The first piston part has a first area A1 upon which fluid can press, and the second piston part has a second area A2 upon which fluid can press. The intermediate part 29 has an outer diameter $OD_I$ that is smaller than the first outer diameter $OD_1$ of the first piston part and the second outer diameter $OD_2$ of the second piston part. Thus, the intermediate part has a smaller cross-sectional area than the first piston part and the second piston part. The second piston part 26 separates the second bore part from a third bore part 30. The first piston 23 has a through-bore 57 providing fluid communication between the first bore part 27 and the third bore part 30 so that the fluid pressure in the first bore part 27 is equalised with the fluid pressure in the third bore part 30. The area difference between the first piston part and the second piston part will cause the piston to move from the first position to the third position, and therefore a shear pin 91 is arranged to engage the second piston part so that the first piston moves after the expandable metal sleeves have been expanded, and the pressure builds up. In the third position, fluid is allowed to flow between the third opening 53 and the second opening 52 on the outside of the intermediate part 29 as shown in FIG. 3B. The valve assembly further comprises a fastening means 61 preventing the first piston from returning to the first position. The fastening means may be at least one element 62 moving radially inwards in the third bore part behind the second piston part as shown in FIG. 3B. The fastening means are several elements in the form of collets 63, and the collets are forced radially inwards by a flexible ring 64.

The annular barrier system may further comprise a pressure-equalising unit 11 as shown in FIG. 5. The valve assembly 5 of FIG. 3B may be connected to either the first or the second annulus via the pressure-equalising unit 11 of FIG. 5, so that the higher of the first and the second pressure is equalised with the pressure of the confined space. The third opening 53 of the valve assembly 5 is connected to the pressure-equalising unit 11 so that in a third position the higher of the first and the second pressure is equalised with the pressure of the confined space and may also be equalised with the annular space of the annular barrier.

By "position" is meant change of a position of e.g. a piston and also a condition or state so that one position may be the closed condition of a shear disc and another position may be the broken and open condition of the shear disc. In this way, the shear disc has changed position, and the valve assembly comprising the shear disc has likewise changed position.

The pressure-equalising unit 11 of FIG. 5 has a first aperture 31 in fluid communication with the first annulus, a second aperture 32 in fluid communication with the second annulus and a third aperture 33 in fluid communication with the valve assembly 5; the pressure-equalising unit has a first unit position in which the first aperture is in fluid communication with the third aperture and a second unit position in which the second aperture is in fluid communication with the third aperture.

In FIGS. 4A-4C, the valve assembly 5 has a second piston 70 moving in a second bore 71. The second piston 70 has a first piston part 72 having a first outer diameter $OD_{P1}$ and a second piston part 73 having a second outer diameter $OD_{P2}$ that is larger than the first outer diameter. In the first position, the second piston divides the second bore 71 into a first bore part 74 and a second bore part 75. In the first position, the second bore part has a fourth opening 54 in fluid communication with the second opening, and the first bore part has a fifth opening 55 in fluid communication with the confined space. The second piston part 73 of the second piston 70 separates the second bore part 75 from a third bore part 79. The first bore part 74 of the second bore of the valve assembly has a sixth opening 56 in fluid communication with the first or second annulus, or both (not at the same time) if the sixth opening is connected with the pressure-equalising unit. The first piston part 72 and the second piston part 73 of the second piston are connected by an intermediate part 76. The first piston part 72 of the second piston has a smaller cross-sectional area than the second piston part. The first piston part 72 of the second piston has a first area A1, and the second piston part 73 of the second piston 70 has a second area A2. The intermediate part 76 of the second piston has an outer diameter that is smaller than the first outer diameter $OD_{P1}$ of the first piston part and the second outer diameter $OD_{P2}$ of the second piston part 73 in order to ease the flow passage, but the outer diameter of the intermediate part 76 may also be the same as that of the first piston part in another embodiment. The first outer diameter $OD_{P1}$ matches the inner diameter $ID_{1S}$ of the first bore part 74, and the second outer diameter $OD_{P2}$ matches the inner diameter $ID_{2S}$ of the first bore part 74. The intermediate part 76 of the second piston 70 has a smaller cross-sectional area than the first piston part 72 and the second piston part 73. The intermediate part 76 of the second piston 70 has a central opening 77 into a central bore 78 fluidly connecting the second bore part 75 and the third bore part 79 of the second bore. The central bore is not a through-bore as the first piston part is solid. In that way, the fluid pressure in the second bore part is the same as in the third bore part, and due to the area difference between the first piston part 72 and the second piston part 73, the pressure will force the piston to move, and in order to prevent that from occurring before the annular space is expanded, a second shear pin 92 engages the second piston part. The second shear pin 92 in the second piston has a lower shear rating than that of the first shear pin 91 in the first piston. Thus, the first shear pin 91 is designed to break after the second shear pin 92. The second piston has fastening means 61 prohibiting the second piston from returning to the first position. The fastening means 61 may be at least one element 62 moving radially inwards in the third bore part behind the second piston part. The fastening means are several elements in the form of collets 63. The elements are forced radially inwards by a flexible ring 64. The pistons 23, 70 have sealing means 88.

In FIG. 4A, the valve assembly is in its first position, also called expansion mode, where the pressurised fluid from the bore having a first predetermined pressure is allowed to flow into the first opening 51 past the first bore part 27 to the second opening 52 and into the fluid channel 58 to the annular barriers and the fourth opening 54. In the first position, the fourth opening is not fluidly connected to the fifth or sixth opening—only to the second bore part 75 and the third bore part 79. The second shear pin holds the second piston in place during expansion of the annular barriers, and the first shear pin 91 holds the first piston in place during expansion of the expandable metal sleeves of the annular barriers. In the first position, the fifth and sixth openings 55, 56 are in fluid communication as a result of which, during expansion, the confined space is in fluid communication with the third aperture of the pressure-equalising unit so that no pressure is trapped in the confined space. After expansion of the annular barriers, the pressure builds up to a second predetermined pressure high enough to shear the second shear pin 92 so that the second piston moves to the second position of the valve assembly 5, as shown in FIG. 4B, and a small pressure drop will occur, which verifies that the valve assembly is now in test mode, i.e. the second position. In the second position, the pressure is further increased, building up to a third predetermined pressure in the confined space and in the annular space of both the first and second annular barriers. The third predetermined pressure is maintained for a predetermined period to verify if the confined space is leaking. If the pressure can be maintained, the barrier, i.e. the first and second annular barriers, is verified, and if the pressure cannot be maintained, one of the first and second annular barriers is not sealing sufficiently against the wall. The third predetermined pressure is lower than what is needed to break the first shear pin 91. The pressure is then increased to a fourth predetermined pressure, and the shear pin 91 breaks, allowing the first piston to move, and the valve assembly changes position to the third position, as shown in FIG. 4C. In the third position, the fluid communication to the bore is closed, and fluid communication is provided between the second opening and the third opening connected to the third aperture of the pressure-equalising unit, thereby enabling fluid communication between the pressure-equalising unit, the annular barriers and the confined space. Thus, in the third position the pressure in the first or second annulus (depending on the unit position of the pressure-equalising unit) is equalised with the pressure in the annular spaces and the confined space. As shown in FIGS. 4A-4C, the first and second bores may be provided in the same valve block 93, which is indicated by a dotted line, or in two blocks fluidly connected with hydraulic lines creating fluid channels.

In FIG. 5, the pressure-equalising unit 11 has a first unit position providing fluid communication between the first annulus and the confined space via the valve assembly if the first pressure is higher than the second pressure, and a second unit position providing fluid communication between the second annulus and the confined space via the valve assembly if the second pressure is higher than the first pressure. Thus, the third aperture of the pressure-equalising unit 11 is connected to the sixth opening to prevent pressure from being trapped in the confined space during expansion when the valve assembly is in its first position, providing fluid communication between the fifth and the sixth opening. The third aperture of the pressure-equalising unit 11 is also connected to the third opening so that in the third position the highest pressure in the first and second annuli is equalised with the pressure in the confined space and the annular spaces of the first and second annular barriers. The third aperture is not fluidly connected to the sixth opening and the third opening at the same time. By having the third opening fluidly connected to the pressure-equalising unit in the third position, it is ensured that the highest pressure of the first and second pressure is always equalised with the pressure in the confined space and the annular barriers. In this way, it is ensured that the first annular barrier either experiences no pressure difference across the barrier (if the first pressure in the first annulus is higher than the second pressure in the second annulus), or that the pressure in the confined space is higher than the first pressure in the first annulus. The absence of any pressure difference across the barrier is not a problem to the collapse resistance of the annular barrier. The first annular barrier is thus only exposed to the same pressure difference as when the first annular barrier is tested during the pressurisation of the confined space where the valve assembly is in the second position. Likewise, it is ensured that the second annular barrier either experiences no pressure difference across the barrier (if the second pressure in the second annulus is higher than the first pressure in the first annulus), or that the pressure in the confined space is higher than the second pressure in the second annulus. The second annular barrier is thus only exposed to the same pressure difference as when it is tested during the pressurisation of the confined space where the valve assembly is in the second position.

In FIG. 5, the pressure-equalising unit 11 comprises an element 20 movable at least between the first unit position and the second unit position. The pressure-equalising unit has the first aperture 31 which is in fluid communication with the first annulus, the second aperture 32 which is in fluid communication with the second annulus and the third aperture 33 which is in fluid communication with the confined space 10 via the valve assembly 5. In the first unit position, the first aperture is in fluid communication with the third aperture, equalising the first pressure $P_1$ with the confined pressure Pc via the valve assembly, and in the second unit position the second aperture 32 is in fluid communication with the third aperture 33, equalising the second pressure $P_2$ with the confined pressure Pc via the valve assembly 5. In the first unit position, the first pressure $P_1$ is higher than the second pressure $P_2$, and in the second unit position the second pressure $P_2$ is higher than the first pressure $P_1$.

As shown in FIG. 4B, the confined space is fluidly disconnected from the third aperture and the sixth opening in the second position and thus disconnected from the first annulus and the second annulus.

As can be seen in FIG. 2, the annular barrier system comprises both the valve assembly 5 and the pressure-equalising unit 11. A first fluid channel 21 of a first line is fluidly connecting the first aperture of the pressure-equalising unit 11 with the first annulus on the other side of the first annular barrier 1A, and a second fluid channel 22 of a second line is fluidly connecting the second aperture of the pressure-equalising unit 11 with the second annulus on the other side of the second annular barrier 1B. The first fluid channel 21 is thus arranged between the expandable metal sleeve 8 and the tubular metal part 7 of the first annular barrier 1, 1A, and the second fluid channel 22 is arranged between the expandable metal sleeve 8 and the tubular metal part 7 of the second annular barrier 1, 1B.

As can be seen in FIGS. 6A and 6B, the pressure-equalising unit 11 has a piston 37 moving between the first position, shown in FIG. 6A, and the second position, shown in FIG. 6B. The pressure-equalising unit 11 has a first aperture 31 in fluid communication with the first annulus 101, a second aperture 32 in fluid communication with the second annulus 102 and a third aperture 33 in fluid communication with the confined space 10. The pressure-equalising unit 11 has a bore 34 in which the piston 37 slides, dividing the bore into a first chamber 35 and a second chamber 36. The bore has a bore face 39, and the piston has a first indentation 44 providing a first cavity 41 with the bore face 39 and a second indentation 45 providing a second cavity 42 with the bore face 39. In the first position, the first cavity 41 provides fluid communication between the first aperture 31 and the third aperture 33, and in the second position the second cavity 42 provides fluid communication between the second aperture 32 and the third aperture 33. The piston comprises a first fluid channel 46 fluidly connecting the first chamber 35 with the second cavity 42, and a second fluid channel 47 fluidly connecting the second chamber 36 with the first cavity 41. The higher pressure of the first and the second annulus thereby pushes the piston so that if the highest pressure is in the first annulus, the piston is moved to the second position, as a result of which the lower pressure in the second annulus is equalised with the pressure in the confined space. The piston is thus moved between the first and the second position, and in the first position the second aperture 32 is disconnected from the third aperture and the confined space, and in the second position the first aperture 31 is disconnected from the third aperture and the confined space. The pressure-equalising unit 11 thereby ensures that pressure is not trapped in the confined space; however, the first annular barrier and the second annular barrier are exposed to a different differential pressure than when the barrier is tested and verified. However, the barrier is still verified during the testing step in the second position.

As shown in FIG. 2, the expandable metal sleeve may be connected to the tubular metal part by means of connection parts 64B.

In FIG. 5, the pressure-equalising unit 11 comprises an element 20 movable between a first unit position (moving to end 36B in FIG. 5) and a second unit position (moving to end 36A in FIG. 5), compressing compliant material. The pressure-equalising unit 11 has a first aperture 31 which is in fluid communication with the first annulus 101 and a second aperture 32 which is in fluid communication with the second annulus 102, and the pressure-equalising unit 11 has a third aperture 33 which is in fluid communication with the annular space 15 and the confined space through the valve assembly when being in the third position so that the first piston blocks the first opening 51. The first aperture 31 is in fluid communication with the third aperture 33 for equalising the first pressure of the first annulus 101 with the pressure of the annular space and the confined space in the first unit position and when the valve assembly is in the third position; and in the second unit position the second aperture 32 is in fluid communication with the third aperture 33 for equalising the second pressure of the second annulus with the pressure of the annular space and the confined space in the first unit position and when the valve assembly is in the third position.

The bore 9 may be pressurised from above/the surface, or a zone in the bore may be pressurised by means of a tool isolating a zone opposite the annular barriers.

In FIG. 8, the annular barrier system comprises three annular barriers 1, 1A, 1B, 1C. The expanded first and second annular barriers 1A, 1B enclose a confined space 10, and the expanded second and third annular barriers 1B, 1C enclose another confined space 10. The two confined spaces 10 are fluidly connected by a fluid channel (not shown), and the annular barriers 1 are fluidly connected via other fluid channels 18. In this way, all the annular barriers can be fully energised with the highest differential pressure of either the first annulus 101 or the second annulus 102. If the annular barrier system comprises more than three annular barriers, they would be fluidly connected in a similar manner to fluidly connect the confined spaces and, separately, fluidly connect the annular barriers. Sometimes, there may be uncertainty as to where exactly the annular barriers are to be positioned, and therefore the operator would want to use three or more annular barriers. Also, when a very high axial load is required over a weak rock to prevent damage, the operator may also want to use three or more annular barriers.

When using three or more annular barriers, the pressure-equalising unit 11 is arranged in the same manner as when having two annular barriers, and the first aperture 31 is in fluid communication with the first annulus, the second aperture 32 in fluid communication with the second annulus and the third aperture 33 is in fluid communication with the valve assembly 5. In order to prevent pressure from being trapped in one of the confined spaces, as such trapped pressure may result in the shearing of the shear pin requiring a higher pressure, the third aperture 33 is fluidly connected to the third opening of the valve assembly so that the shear pin 91 experiences the bore pressure on one side and the highest pressure of the first or second annulus and thus shear on the same conditions as when using two annular barriers.

By "fluid" or "well fluid" is meant any kind of fluid that may be present in oil or gas wells downhole, such as natural gas, oil, oil mud, crude oil, water, etc. By "gas" is meant any kind of gas composition present in a well, a completion or an open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, which wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. An annular barrier system for completing a well with a well tubular metal structure, comprising:

the well tubular metal structure and a first annular barrier and a second annular barrier, each annular barrier comprising:

a tubular metal part having a bore and mounted as part of the well tubular metal structure, an expandable metal sleeve surrounding the tubular metal part, each end of the expandable metal sleeve being connected with the tubular metal part, and an annular space between the expandable metal sleeve and the tubular metal part, each annular barrier being introduced and set in the well to abut a wall of the well, providing a confined space having a confined pressure between the wall, part of the well tubular metal structure, the first annular barrier and the second annular barrier so that the first annular barrier isolates the confined space from a first annulus having a first pressure, and the second annular barrier isolates the confined space from a second annulus having a second pressure, wherein the annular barrier system comprises a valve assembly having a first position in which the bore is in fluid communication with the annular space of at least one of the first annular barrier and the second annular barrier in order to expand the expandable metal sleeve, and a second position in which the bore is in fluid communication with the confined space in order to perform a barrier verification by pressurising the confined space.

2. The annular barrier system according to claim 1, wherein the valve assembly further comprises a third position in which fluid communication with the bore is closed.

3. The annular barrier system according to claim 1, wherein, in the second position, the bore is in fluid communication with the annular space of at least one of the annular barriers.

4. The annular barrier system according to claim 1, wherein, in the first position, the bore is fluidly disconnected from the confined space.

5. The annular barrier system according to claim 1, further comprising a pressure-equalising unit having a first aperture in fluid communication with the first annulus, a second aperture in fluid communication with the second annulus and a third aperture in fluid communication with the valve assembly, the pressure-equalising unit having a first unit position in which the first aperture is in fluid communication with the third aperture and a second position in which the second aperture is in fluid communication with the third aperture.

6. The annular barrier system according to claim 5, wherein, in the first position of the valve assembly, the third aperture is in fluid communication with the confined space via the valve assembly, preventing pressure from being trapped in the confined space during expansion of the expandable metal sleeves.

7. The annular barrier system according to claim 5, wherein, in the third position of the valve assembly, the third aperture is in fluid communication with the annular space.

8. The annular barrier system according to claim 5, wherein, in the third position of the valve assembly, the third aperture is in fluid communication with the confined space.

9. The annular barrier system according to claim 5, wherein, in the first unit position, the first annulus is in fluid communication with the confined space via the valve assembly, and in the second unit position the second annulus is in fluid communication with the confined space via the valve assembly; in the first unit position the first pressure is higher than the second pressure, and in the second position the second pressure is higher than the first pressure.

10. The annular barrier system according to claim 5, wherein the valve assembly has a first piston moving a first bore, the first piston having a first piston part and a second piston part;

in the first position the first piston part divides the first bore into a first bore part and a second bore part; and in the first position the first bore part has a first opening in fluid communication with the bore and a second opening in fluid communication with the annular space of at least one of the first annular barrier and the second annular barrier; and in the first position the second bore part has a third opening in fluid communication with the first annulus or the second annulus.

11. The annular barrier system according to claim 10, wherein the second opening in the second position is in fluid communication with the confined space.

12. The annular barrier system according to claim 10, wherein the valve assembly changes to the third position as the first piston moves in the first bore, and in the third position the first piston blocks fluid communication with the bore.

13. The annular barrier system according to claim 5, wherein the valve assembly has a second piston moving a second bore, the second piston having a first piston part and a second piston part; in the first position the second piston divides the second bore into a first bore part and a second bore part, and in the first position the second bore part has a fourth opening in fluid communication with the second opening, and the first bore part has a fifth opening in fluid communication with the confined space.

14. The annular barrier system according to claim 1, wherein the valve assembly further comprises a first shear pin engaging the first piston so as to prevent the first piston from moving before the expandable metal sleeves of the annular barriers are expanded.

15. The annular barrier system according to claim 1, wherein the valve assembly further comprises a second shear pin engaging the second piston so as to prevent the second piston from moving before the expandable metal sleeves of the annular barriers are expanded, the first shear pin being designed to break after the second shear pin.

* * * * *